US005355900A

United States Patent [19]

Sakata

[11] Patent Number: 5,355,900

[45] Date of Patent: Oct. 18, 1994

[54] DISHWASHER WITH DRYING CYCLE

[75] Inventor: Hiroshi Sakata, Seto, Japan

[73] Assignee: Kabushiki Kaisha Toshiba, Kawasaki, Japan

[21] Appl. No.: 983,767

[22] Filed: Dec. 1, 1992

[30] Foreign Application Priority Data

Dec. 5, 1991 [JP] Japan ..... 3-321872

[51] Int. Cl.[5] ..... A47L 15/48

[52] U.S. Cl. ..... 134/95.2; 34/77; 134/107

[58] Field of Search ..... 34/76, 77; 134/95.2, 134/107, 108; 68/20

[56] References Cited

U.S. PATENT DOCUMENTS

| | | | |
|---|---|---|---|
| 2,777,313 | 1/1957 | Dodge | 68/20 |
| 3,026,628 | 3/1962 | Berger, Sr. et al. | 34/76 X |
| 3,068,877 | 12/1962 | Jacobs | 134/99.1 |
| 3,598,131 | 8/1971 | Weihe, Jr. | 134/107 |
| 3,616,810 | 11/1971 | Ter Bush | 134/107 X |
| 5,029,458 | 7/1991 | Obata et al. | 68/20 X |
| 5,076,306 | 12/1991 | Suzuki et al. | 68/20 X |

FOREIGN PATENT DOCUMENTS

| | | | |
|---|---|---|---|
| 2-218327 | 8/1990 | Japan . | |
| 1223274 | 2/1971 | United Kingdom | 34/77 |
| 1244467 | 9/1971 | United Kingdom . | |
| 1410501 | 10/1975 | United Kingdom . | |
| 2172977 | 10/1986 | United Kingdom . | |
| 2172978 | 10/1986 | United Kingdom . | |

*Primary Examiner*—Philip R. Coe

*Attorney, Agent, or Firm*—Cushman, Darby & Cushman

[57] ABSTRACT

A dishwasher includes a chamber containing the dishes, a heater for heating the air in the chamber, a water inlet provided on the upper side of the chamber, a drain pump for draining the water from the chamber, an air circulation passage through which the air in the chamber is circulated, a fan for circulating the air in the chamber through the air circulation passage, a dehumidifying surface capable of holding water provided in the air circulation passage, and a microcomputer for controlling the drain pump, the fan and the volume of the water supplied from the water inlet. In a drying cycle, the air heated by the heater is circulated through the air circulation passage. Since the air contacts with the water spread over the dehumidifying surface, and is cooled down, the water is condensed from the air. Therefore, when the air is heated again, the evaporation of the drops of water on the dishes increases.

11 Claims, 1 Drawing Sheet

DISHWASHER WITH DRYING CYCLE

BACKGROUND OF THE INVENTION

The present invention relates to a dishwasher with drying cycle and more particularly to a dishwasher which circulates the air within a chamber of the dishwasher, and which does not exhaust the air in the chamber to the outside of the chamber thereof, and which dries dishes in the chamber after washing and rinsing the dishes.

A dishwasher including a dry cycle, during which the dishes in the chamber are dried while the air with moisture circulated in the chamber of the dishwasher is not exhausted to the outside of the dishwasher, is known in Japan Patent Publication No. 02-218327. A type of this dishwasher with the drying cycle has a heat transfer assembly comprising a heat transfer fan and a motor driving the heat transfer fan. The heat transfer fan is provided on the rear side of the chamber, and transfers the heat between the air within the chamber and the air on the outside of the chamber so as to dehumidify the air within the chamber. The air within the chamber is circulated, and the outside air is circulated to pass over the heat exchanger. In this type of the dishwasher, during a drying cycle, cold water is supplied to the bottom of the chamber to promote the heat transfer between the cold water and the humid air within the chamber, also.

Therefore, the motor driving the heat transfer fan requires much torque to promote the dehumidifying operation, and the structure of the heat transfer assembly is complex.

SUMMARY OF THE INVENTION

It is an object of the present invention to provide a dishwasher which can dry the dishes in the chamber efficiently, and which is constructed simply without a complex heat transfer assembly comprising a motor and heat transfer fan.

It is another object of the present invention to provide a dishwasher in which the air within the chamber is not exhausted out of the chamber.

In order to achieve the above objects of the present invention, there is provided a dishwasher comprising:

a) a chamber including a dish holding portion for holding dishes;

b) heating means, mounted in the chamber, for heating the air in the chamber to promote drying of dishes;

c) a drain pump for draining the water out of the chamber;

d) an air circulation passage, through which the air from the dish holding portion of the chamber is circulated;

e) dehumidifying surface means capable of holding water, provided in the air circulation passage, for dehumidifying the air circulated through the air circulation passage; and f) fan means for circulating heated air from the dish holding portion over the dehumidifying surface means and for returning dehumidified air to the dish holding portion;

g) means, connectable to a water supply, for providing water onto the dehumidifying surface means;

h) control means for controlling the drain pump, the fan means and water providing means so that heated air from the dish holding portion is dehumidified and returned to the dish holding portion, and the drain pump drains water from the chamber, thereby drying the dishes hold in the dish holding portion.

DESCRIPTION OF THE PREFERRED EMBODIMENTS

Figure 1:
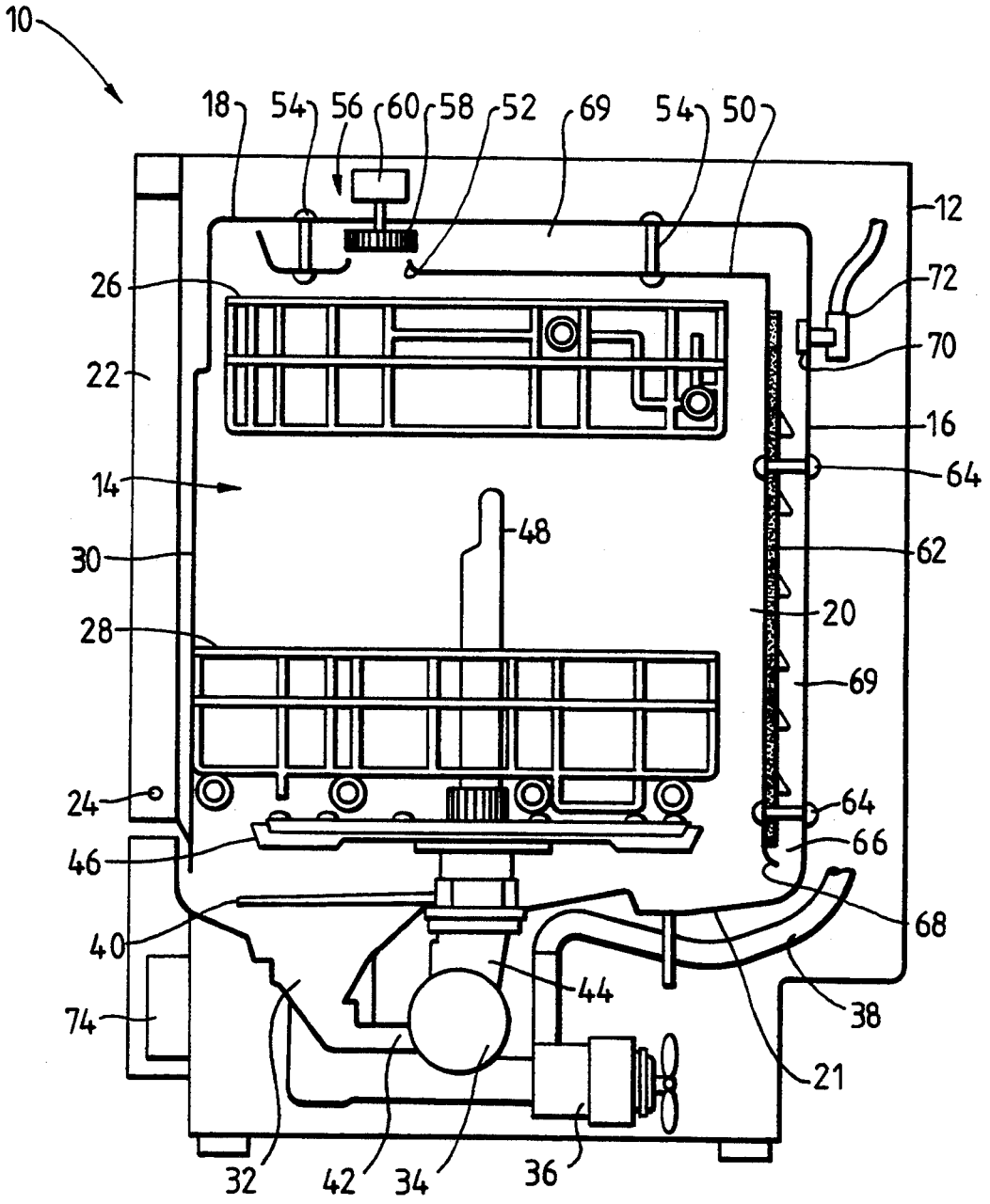
FIG. 1 is a view in vertical section of the dishwasher including the present invention.

An embodiment of the present invention will now be described with reference to FIG. 1. A dishwasher 10 is comprised of an outer casing 12 that surrounds a dishwashing chamber 14 which is defined by a rear wall 16 and an upper wall 18 and a pair of side walls 20 and a bottom wall 21. A door 22 is pivotally mounted by means as pins 24 on the outer casing 12 at the front thereof.

Within a dish holding portion of the dishwashing chamber 14 are located an upper rack 26 and a lower rack 28, for holding dishes and the like, movable into and out of the chamber 14 through an opening 30 of the chamber 14. In the state of the upper rack 26 and the lower rack 28 being forward, some dishes can be stored in the upper and lower racks 26, 28 or be removal from them.

In the bottom wall 21 of the chamber 14 a liquid container 32 is formed, a washing pump 34 for circulating the water in the liquid container 32. And a drain pump 36 having a drain pipe 38 connected to the liquid container 32 for draining the water in the liquid container 32 from the dishwasher 10 through the drain pipe 38, which are located under the chamber 14. A heater 40 as heating means for heating the wash and rinse water in the liquid container 32 during a washing cycle, and for heating the air in the chamber 14 during the drying cycle of the dishes is mounted to the bottom wall 21 so that the heater 40 is located under the water level during the washing cycle of the dishes. A sucking inlet 42 of the washing pump 34 is connected to the liquid container 32, and an exhaust outlet 44 thereof is connected to a revolvable spray arm 46 and a nozzle 48 provided on the bottom wall 21 for projecting the water. Under the upper wall 18 of the chamber 14 an air plate 50 having a inlet hole 52 is fixed on the upper wall 18 by four screws 54 with a horizontal uniform distance between the upper wall 18 and the air plate 50.

Fan means 56 which comprises a fan 58 and a motor 60 actuating the fan 58 is located in accordance with the inlet hole 52. A dehumidifying surface 62, has dehumidifying means mounted vertically and at a uniform distance from the rear wall 16 by two screws 64, which is capable of holding water therein. Dehumidifying surface 62 can be provided as a water holding material such as felt or a metallic mesh. The dehumidifying surface 62 is connected to the air plate 50 at an upper rear corner in the chamber 14, and a blowing outlet 66 is formed between an under-edge 68 of the dehumidifying surface 62 and the rear wall 16 so that an air circulation passage 69 is formed from the inlet hole 52 to the blowing outlet 66 through the upper side and the rear side within the chamber 14. A water inlet 70 is located on the upper part of the rear wall 16 to confront the upper portion of the dehumidifying surface 62, and is connectable to a water supply through a water valve 72. A controller 74 as control means including a micro-computer with a memory storing a program, which controls the actuations of the water valve 72, the fan means 56, the heater 40, the washing pump 34 and the drain pump 36 on the basis of the program in the memory.

The operation of the dishwasher thus arranged will now be described.

After the dishes which are contained in the upper and the lower racks 26, 28 are stored in the chamber 14, the door 22 is closed and the washing cycle of the dishes commences.

In the washing cycle, water valve 72 is opened on the basis of an output signal from the controller 74, then water is supplied to the chamber 14 then through the water inlet 70. Then the water level rises up until that the heater 40 is submerged below the water level, the water valve 72 is closed so that the water is not supplied further. When the water is supplied through the water inlet 70, at first the water flows to the dehumidifying surface 62, then flows into the chamber 14 and the liquid container 32 along the dehumidifying surface 62 and through the blowing outlet 66. Next, the water in the liquid container 32 is spread toward the dishes contained in the upper and lower racks 26, 28 upwardly through the spray arm 46 and the nozzle 48. During the washing cycle, the heater 40 is actuated, and the water heated by the heater 40 is circulated in the chamber 14 by the washing pump 34 to wash the dishes. During this time, when the door 22 is closed, the detergent held on the inside of the door 22 is dropped to the water in the chamber 14, so the water and the detergent are mixed together. After the washing cycle, actuations of both the heater 40 and the washing pump 34 are stopped, and the drain pump 36 is actuated to drain the water with detergent from the dishwasher 10 through the drain pipe 38. Then the rinse cycle is started.

In the rinse cycle, the water valve 52 is opened again and the washing pump 34 is actuated so that the detergent attached to the dishes is removed therefrom. Then, the drain pump 36 is actuated to drain the rinse water from the dishwasher 10 through the drain pipe 38. The above rinse cycle operations is performed several times.

Finally, the drying cycle is started wherein the water on the dishes is evaporated. In the drying cycle, the heater 40 is actuated intermittently, the fan means 56 is actuated continuously, and the water valve 72 is opened temporarily so as to supply the water to the dehumidifying surface 62. The water supplied to the dehumidifying surface 62 is spread on substantially the whole surface thereof. Since the relative humidity of the air in the chamber heated by the heater 40 is lower, the air promotes the evaporation of the waterdrops on the dishes. Then, the heated air absorbing the moisture in the chamber is sucked into the inlet hole 52, and is then exhausted from the blowing outlet 66 through the air circulation passage 69, since the fan means 56 is actuated. In the air circulation passage 69, when the air flows between the dehumidifying surface 62 and the rear wall 16, since the heated air contacts with the dehumidifying surface 62, the heated air is cooled down by the water. Since the water on the surface 62 has a low temperature compared with the heated air, some drops of water are condensed from the heated air. Therefore, the absolute humidity of the air becomes lower, i.e. the air is dryed. Since the dried, cooled down air is heated again and the relative humidity of the air becomes lower, the air promotes the evaporation of the waterdrops on the dishes. Accompanying the above performance, the temperature of the water kept on the dehumidifying surface 62 increases gradually. In the drying cycle, since the water valve 72 is opened intermittently, cold water is supplied to the dehumidifying surface 62 intermittently. When the water is supplied several times, water heated by the transfer of the heat from the air is collected in the liquid container 32 in the chamber 14. Then, the water is drained from the dishwasher 10 by actuating the drain pump 36 intermittently.

A cycle of several opening operations of valve 72 and one operation of the water drain is repeated several times during the drying cycle, and finally the drying cycle is completed.

In accordance with the above described embodiment, while the air in the chamber 14 is heated by the heater 40 in the drying cycle, it is circulated through the air circulation passage 69. The heated air is then cooled down by the water on the dehumidifying surface 62. The water is supplied from the water inlet 70 several times to the dehumidifying surface 62. The drain pump 36 is actuated intermittently to drain the water from the dishwasher 10. Therefore, the structure of the dishwasher 10 becomes simple, and there is no need for a fan or a motor with high torque, since it is sufficient to operate the drying cycle by transferring heat with water alone. Further, with this drying method, and it is not necessary to transfer the heat between the air in the chamber and the air of the outside of the dishwasher 10.

Thus, in accordance with the dishwasher of the illustrated embodiment, during drying cycle of the dishwasher, the heater 40 heats the air in the chamber and the temperature of the air in the chamber rises. Then some drops of water on the dishes are evaporated gradually. Consequently, the rate of the evaporation decrease, since the humidity of the air increases gradually. As water is supplied to the dehumidifying surface 62 through the water inlet, it spreads on the dehumidifying surface 62, and is kept on the surface because of ability of surface 62 to hold the water. The humid air in the chamber is circulated through the air circulation passage by the fan 58, so that the moist air contacts the water held on the dehumidifying surface. At the dehumidifying surface 62, the heat is transferred between the air circulated through the air circulation passage and the water held on the surface 62, and some drops of water are condensed from the vapor in the air. This condensation occurs because the temperature of the air is under the dew point. Since the cooled down air is reheated by heater 40, the relative humidity of the reheated air is low, and the evaporation of drops of water on the dishes is promoted. Because both the water supplied through the water inlet and some drops of water condensed from the air are drained out together from the dishwasher by the drain pump, the water will not be evaporated again within the chamber. Therefore, the dishes are dried efficiently.

Further, when the water is supplied and drained repeatedly and intermittently, and the temperature of the water on the dehumidifying surface 62 is maintained low, the moisture of the circulated air readily condenses on the dehumidifying surface 62 and the efficiency of drying the dishes increases.

Further, in the type of prior art dishwasher in which heat is transfered between the inside air and the outside air, the water and the moisture may leak out from a peripheral sealing portion of a heat transferring fan. In contrast, in accordance with the present invention, since dehumidifying can be performed only within the dishwashing chamber, the water and the moisture do not leak out from the dishwasher.

Moreover, the dehumidifying surface 62 and the rear wall 16 are constructed as a part of the air circulation passage 69, so that additional parts for the air circulation passage 69 are not necessary.

Moreover, the dehumidifying surface 62 is positioned vertically, and the upper portion of the surface 62 preferably confront the water inlet 72, so that the water supplied from the water inlet 70 drains down according to gravity, and the water spreads over substantially the whole of the dehumidifying surface 62 efficiently.

Further, when the dehumidifying surface 62 is constructed from felt, the surface 62 has the capability of including water and, since the water supplied to the surface 62 from the water inlet 70 also moves up to the upper portion of the surface 62 rather than the position of the water inlet 70 by the capillary action, the water spreads over substantially the whole of the dehumidifying surface 62 more widely, and the dehumidifying efficiency rises up.

When the dehumidifying surface 62 is provided as a metallic mesh, it is easy to remove the refuse of food attached to the metallic mesh.

Since the water inlet 70 is located rear the dehumidifying surface 62, the water supplied from the water inlet 70 is not projected to the dishes directly. As a result, the dishes are not broken by the water force, and no noise results from a contact of the water and the dishes.

In the above embodiment, the water inlet 70 may be attached to the dehumidifying surface 62, and the dehumidifying surface 62 may merely be hung on, for example, hooks instead of the screws 64 so that the dehumidifying surface 62 can be detached from the rear wall 16 easily for efficient cleaning.

Alternatively, the surface of the dehumidifying surface 62 can be provided as a curved or pleated surface instead of a flat surface, or the surface can be changed to have plural layers. As a result, the area of surface 62 which the air can contact increases, and the dehumidifying efficiency also increases.

The pattern defining the number of water supplying and draining operations in the drying cycle can be varied without adversely affecting the drying operation in accordance with the present invention.

The foregoing disclosure and drawing are merely illustrative of the principles of the present invention and are not to be interpreted in a limiting sense. The only limitation is to be determined from the scope of the appended claims.

The inlet 70 does not have to be at top of surface 62—for example use spray nozzle.

What I claim is:

1. A dishwasher, comprising:

a) a chamber including a dish holding portion for holding dishes;

b) heating means, mounted in the chamber, for heating the air in the chamber to promote drying of dishes;

c) a drain pump for draining the water out of the chamber;

d) an air circulation passage, through which the air from the dish holding portion of the chamber is circulated;

e) dehumidifying surface means capable of holding water, provided in the air circulation passage, for dehumidifying the air circulated through the air circulation passage; and f) fan means for circulating heated air from the dish holding portion over the dehumidifying surface means and for returning dehumidified air to the dish holding portion;

g) means, connectable to a water supply, for providing water onto the dehumidifying surface means;

h) control means for controlling the drain pump, the fan means and water providing means so that heated air from the dish holding portion is dehumidified and returned to the dish holding portion, and the drain pump drains water from the chamber after the water supply means have been activated at least once so that the water is not allowed to heat to evaporation before being drained, thereby drying the dishes located in the dish holding portion.

2. A dishwasher according to claim 1, wherein the control means activates the water providing means and the drain pump intermittently so that only one is operated at any given time during drying of the dishes.

3. A dishwasher according to claim 1, wherein the dehumidifying surface means has plural layers.

4. A dishwasher according to claim 1, wherein the dehumidifying surface means is a felt.

5. A dishwasher according to claim 1, wherein the dehumidifying surface means is a metallic mesh.

6. A dishwasher according to claim 1, wherein the dehumidifying surface means comprises a wall portion of the air circulation passage.

7. A dishwasher according to claim 1, wherein the dehumidifying surface means is positioned substantially vertically.

8. A dishwasher according to claim 1, wherein the dehumidifying surface means is detachable.

9. A dishwasher according to claim 1, wherein a surface of the dehumidifying means is configured to increase surface area.

10. A dishwasher, comprising:

a) a chamber, having an upper wall, for containing dishes;

b) heating means, mounted in the chamber, for heating the air in the chamber;

c) a water inlet, connectable to a water supply, provided on an upper side of the chamber;

d) a drain pump for draining the water out of the chamber;

e) a rack for storing the dishes in the chamber;

f) a washing pump for circulating the water in the chamber so that the dishes in the rack are washed by the water;

g) a water valve, connected to the water inlet, through which the water is supplied from the water supply;

h) an air circulation passage having a inlet and an outlet provided in the chamber, through which the air in the chamber is circulated from the inlet to the outlet;

i) fan means, provided on the upper wall, for circulating the air in the chamber through the air circulation passage;

j) dehumidifying surface means capable of holding water, positioned vertically in the air circulation passage and below the water inlet, for absorbing the heat of the air circulated through the air circulation passage; and k) control means for controlling the drain pump, the fan means and the water valve so that the water valve supplies the water onto the dehumidifying surface means, and the fan means circulates the heated air from the chamber to contact the water on the dehumidifying surface means, and the drain pump drains the water supplied through the water inlet after the water supply means have been activated at least once so that the water is not allowed to heat to evaporation before being drained during a dish drying cycle of the dish washer.

11. A dishwasher according to claim 10, wherein the control means includes means for opening the water valve and for actuating the drain pump intermittently, during the dish drying cycle.

* * * * *